US008855509B2

(12) United States Patent
Fujiwara et al.

(10) Patent No.: US 8,855,509 B2
(45) Date of Patent: Oct. 7, 2014

(54) HEATING APPARATUS AND VOLTAGE DETECTION APPARATUS

(75) Inventors: Yuji Fujiwara, Susono (JP); Yasuhiro Shimura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 355 days.

(21) Appl. No.: 13/158,284

(22) Filed: Jun. 10, 2011

(65) Prior Publication Data

US 2011/0305469 A1 Dec. 15, 2011

(30) Foreign Application Priority Data

Jun. 14, 2010 (JP) ..... 2010-135501

(51) Int. Cl.
*G03G 15/20* (2006.01)

(52) U.S. Cl.
CPC ..... *G03G 15/2078* (2013.01)
USPC ..... 399/33

(58) Field of Classification Search
USPC ..... 399/33, 320
See application file for complete search history.

(56) References Cited

U.S. PATENT DOCUMENTS

| | | | | |
|---|---|---|---|---|
| 5,229,577 | A * | 7/1993 | Matsuura et al. | 219/497 |
| 8,010,007 | B2 * | 8/2011 | Sano et al. | 399/69 |
| 2002/0098006 | A1 * | 7/2002 | Tamaoki | 399/69 |
| 2008/0267643 | A1 * | 10/2008 | Takami | 399/33 |
| 2009/0074442 | A1 * | 3/2009 | Sano et al. | 399/69 |
| 2009/0245847 | A1 * | 10/2009 | Yuda | 399/88 |
| 2011/0085815 | A1 * | 4/2011 | Kishi et al. | 399/69 |

FOREIGN PATENT DOCUMENTS

JP 7-199702 A 8/1995

* cited by examiner

*Primary Examiner* — Walter L Lindsay, Jr.
*Assistant Examiner* — Frederick Wenderoth
(74) *Attorney, Agent, or Firm* — Canon USA Inc IP Division

(57) ABSTRACT

A voltage detection apparatus is configured to detect a voltage value applied to a first or second current path of a heater. The voltage detection apparatus detects a first period during which the voltage value of the first or second current path exceeds a threshold voltage as well as a second period during which electric power is supplied to the first current path or the second current path to control the electric power supplied to the first and second current paths. The voltage detection apparatus uses a detection result to detect a state where over-power is supplied to the heater.

24 Claims, 18 Drawing Sheets

FIG. 5A

502

| TRIAC TR1 ON TIME RATE (%) | ELECTRIC POWER SUPPLIED | CAPACITOR 408 SATURATION VOLTAGE | | COMPARATOR 414 COMPARISON VOLTAGE | RL OFF |
|---|---|---|---|---|---|
| 100% | 4000W | 2.44V | > | 2.0V | LOW |
| 80% | 3200W | 2.58V | > | 2.0V | LOW |
| 60% | 2400W | 2.48V | > | 2.0V | LOW |
| 50% | 2000W | 2.44V | > | 2.0V | LOW |
| 40% | 1600W | 2.30V | > | 2.0V | LOW |
| 25% | 1000W | 1.98V | < | 2.0V | HIGH |

FIG. 5B

501

| TRIAC TR1 ON TIME RATE (%) | ELECTRIC POWER SUPPLIED | CAPACITOR 408 SATURATION VOLTAGE | | COMPARATOR 414 COMPARISON VOLTAGE | RL OFF |
|---|---|---|---|---|---|
| 100% | 4000W | 2.44V | > | 2.0V | LOW |
| 80% | 3200W | 2.35V | > | 2.0V | LOW |
| 60% | 2400W | 2.11V | > | 2.0V | LOW |
| 50% | 2000W | 1.93V | > | 2.0V | HIGH |
| 40% | 1600W | 1.73V | > | 2.0V | HIGH |
| 25% | 1000W | 0.94V | < | 2.0V | HIGH |

HEATING APPARATUS AND VOLTAGE DETECTION APPARATUS

BACKGROUND OF THE INVENTION

1. Field of the Invention

The present invention relates to a heating apparatus applicable to an image forming apparatus, such as a copying machine, a laser beam printer, or a facsimile machine.

2. Description of the Related Art

In general, an image forming apparatus includes a heating device maintained at a predetermined temperature to heat and fix an image formed on a recording material together with a pressing roller that can be pressed against the heating device. The image forming apparatus conveys each recording material to a nip portion and sandwiches the recording material between the heating device and the pressing roller. At the nip portion, an image formed on the recording material is heated and fixed to the recording material. For example, when the heating device is a film heating type, a heater including a resistance heating member formed on a ceramic substrate is provided inside a cylindrical film.

The above-described resistance heating member may be employed in a heater to be used in a region where an available voltage of a commercial AC power source is a 100V type (e.g., in a voltage range from 100 V to 127 V) as well as in a heater to be used in a region where the available voltage is a 200V type (e.g., in a voltage range from 200 V to 240 V). In this case, if the resistance value of the heaters is the same, a serious rise occurs in harmonic current and flicker because electric power supplied to the heater is proportional to the square of the applied voltage.

The maximum electric power that can be supplied to the heater in the region where the available voltage of the commercial AC power source is 200 V is four times the maximum electric power that can be supplied to the heater in the region where the available voltage of the commercial AC power source is 100 V. If the maximum electric power that can be supplied to the heater becomes greater, the harmonic current and flicker that occur in the electric power control of the heater become larger.

Accordingly, it is required to differentiate the resistance value of a heater to be used in the region where the available voltage of the commercial AC power source is 100 V from the resistance value of a heater to be used in the region where the available voltage of the commercial AC power source is 200 V.

Further, a relay switch can be used to switch the heater resistance value, as conventionally known as a method for universalizing a device for both the region where the available voltage of the commercial AC power source is 100 V and the region where the available voltage of the commercial AC power source is 100 V.

For example, as discussed in Japanese Patent Application Laid-Open No. 7-199702 and U.S. Pat. No. 5,229,577, there are conventional apparatuses that employ a method for switching the resistance value of a heater according to the voltage of the commercial AC power source.

More specifically, the above-discussed apparatus includes a first conductive path and a second conductive path extending in a longitudinal direction of the heater. The above-discussed apparatus can perform switching between a first operational state where the first conductive path is connected in series to the second conductive path and a second operational state where the first conductive path is connected in parallel to the second conductive path.

According to the method discussed in the above-described Japanese Patent Application Laid-Open No. 7-199702, a make contact (always open contact) or break contact (always closed contact) relay and a break-before-make contact (BBM contact) relay are used to switch a connection pattern of two conductive paths between "series" and "parallel." In this case, the above-described BBM contact relay can be replaced by two make contact relays or a combination of a make contact relay and a break contact relay. On the other hand, two BBM contact relays are used in the switching method discussed in the above-described U.S. Pat. No. 5,229,577.

According to the above-described conventional methods, the resistance value of the heater can be switched by determining whether the power source voltage is the 100V type or the 200V type and changing the connection pattern of the heater conductive paths between "series" and "parallel", without changing the heat generation area of the heater.

However, according to the above-described methods, if a power source voltage detection unit or a heater resistance value switching relay fails, over-power may be supplied to the heater. For example, in a situation where the voltage is supplied from a 200 V power source, if the heater operation goes into a state where the resistance value becomes smaller, the electric power supplied to the heater possibly increases to four times the normal value and the heater may be immediately broken.

A conventional failure detection circuit that relies on a temperature detection element, such as a thermistor, a temperature fuse, or a thermo SW, requires a relatively long time to convert a detected voltage value to a temperature value. Therefore, the response speed in detection is insufficient and the detection can be delayed significantly.

Therefore, in a heating apparatus that is configured to switch the resistance value of a heater, it is required to surely detect, at early timing, a failure state where over-power is supplied to the heater. Further, even in a state where a bidirectional thyristor (which may be referred to as "TRIAC") is employed to control an operational state of the heater or electric power supplied to the heater, it is required to employ a method capable of surely and promptly detecting the failure state where over-power is supplied to the heater.

SUMMARY OF THE INVENTION

The present invention is directed to an apparatus that can switch a resistance value and is related to a technique capable of surely and promptly detecting a failure state of the heater.

According to an aspect of the present invention, a heating apparatus includes a heater that includes a first current path and a second current path. The heating apparatus according to the present invention includes a switching unit configured to perform switching between a first operational state where the first current path is connected in series to the second current path and a second operational state where the first current path is connected in parallel to the second current path. The heating apparatus further includes a power control unit configured to control electric power supplied to the first and second current paths, and a voltage detection unit configured to detect a voltage value applied to the first or second current path. The voltage detection unit is configured to detect a first period during which the voltage value of the first current path or the second current path exceeds a threshold voltage and a second period during which the power control unit supplies electric power to the first current path or the second current path. Further, the voltage detection unit is configured to detect a state that electric power is supplied to the heater based on a detection result.

Another aspect of the present invention provides a voltage detection apparatus, which can be associated with a heater including a first current path and a second current path and can detect a voltage value applied to the first or second current path of the heater. The voltage detection apparatus according to the present invention includes a first detection unit configured to detect a first period during which the voltage value of the first current path or the second current path exceeds a threshold voltage.

The voltage detection apparatus further includes a second detection unit configured to detect a second period during which an power control unit supplies electric power to the first current path or the second current path in such a way as to control the electric power supplied to the first and second current paths. The voltage detection apparatus uses a detection result obtained by the first detection unit and a detection result obtained by the second detection unit to detect a state that electric power is supplied to the heater.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIGS. 5A, 5B, 5C, and 5D illustrate detection results of the voltage detection circuit according to the first exemplary embodiment of the present invention.

DESCRIPTION OF THE EMBODIMENTS

Various exemplary embodiments, features, and aspects of the invention will be described in detail below with reference to the drawings.

Hereinafter, example configurations and operations according to the present invention are described below with reference to some embodiments, although the present invention is not limited to these exemplary embodiments.

Figure 1:
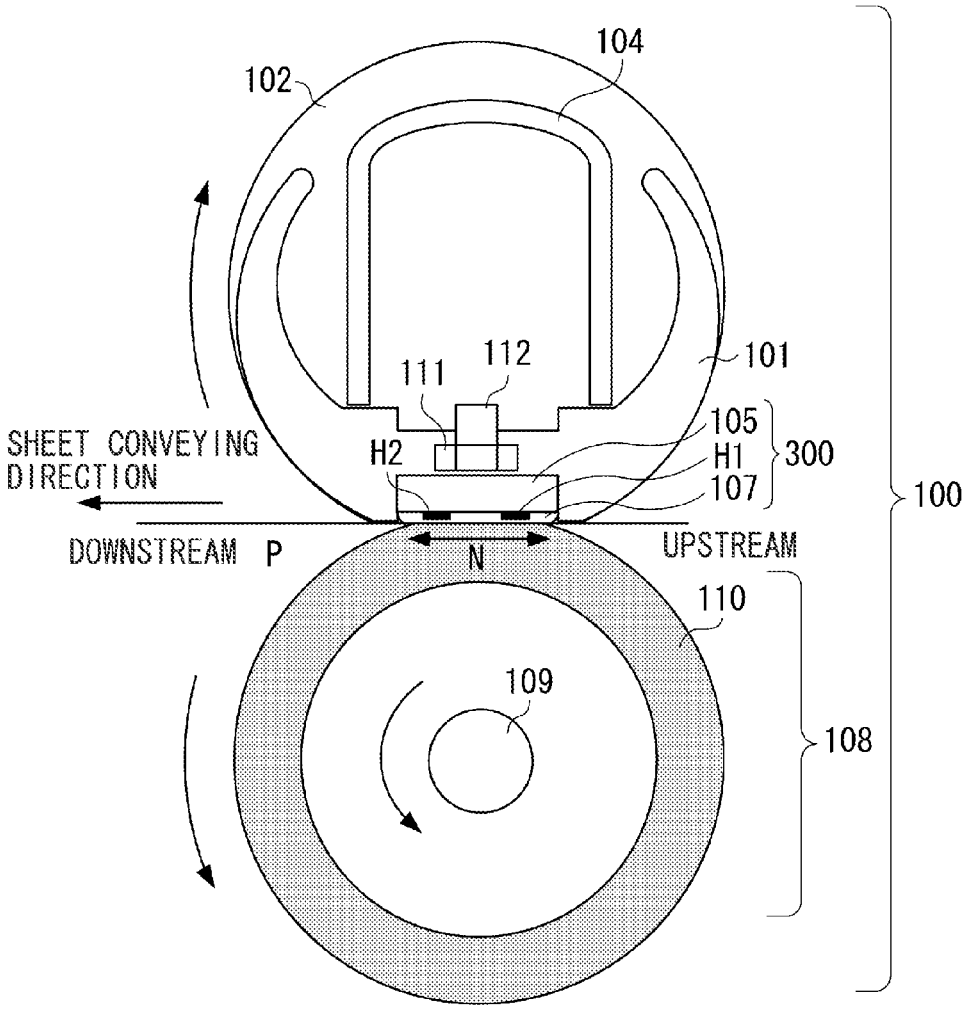
FIG. 1 is a cross-sectional view illustrating a heating apparatus according to an exemplary embodiment of the present invention.

FIG. 1 is a cross-sectional view illustrating a fixing apparatus 100 that can be applied to an image forming apparatus according to an exemplary embodiment of the present invention. The fixing apparatus 100 includes a cylindrical film (or a cylindrical belt) 102 that is functionally operable as a heating device and a pressing roller 108 that is functionally operable as a pressing member.

The fixing apparatus 100 further includes a heater 300. When the heater 300 is pressed against the film 102, a nip portion N can be formed between the heater 300 and the film 102. The heater 300 is configured to contact an inner surface of the film 102. A base layer of the film 102 is made of a polyimide (or other heat-resistant resin) material or a stainless (or other comparable metallic) member. The pressing roller 108 includes a cored bar 109 made of a steel or aluminum material and an elastic layer 110 made of a silicone rubber or a comparable member.

A holding member 101 is made of a heat-resistant resin material and is configured to hold the heater 300. The holding member 101 has a guide function for guiding the film 102 while the film 102 is rotating. The pressing roller 108 rotates in a direction indicated by an arrow when the driving power of a motor (not illustrated) is transmitted to the pressing roller 108. The film 102 is driven by the pressing roller 108. When the pressing roller 108 rotates in the counterclockwise direction, the film 102 rotates in a clockwise direction, as indicated by arrows in FIG. 1.

The heater 300 includes a ceramic heater substrate 105, a first conductive (current) path H1 and a second conductive (current) path H2 that are made of thermal resistance members and formed on the substrate 105, and an insulating surface protective layer 107 (e.g., a glass layer in the present exemplary embodiment) that covers two conductive paths H1 and H2.

A temperature detection element 111, such as a thermistor, is positioned on a reverse surface side of the heater substrate 105 and is brought into contact with a sheet passing area of a usable minimum-size paper (e.g., an envelope size (110 mm width) in the present exemplary embodiment), which is set beforehand for each printer. Electric power supplied from a commercial AC power source 201 (see FIG. 2) to a heater line is controlled according to a detection temperature of the temperature detection element 111.

A recording material (e.g., a sheet) on which a toner image is formed can be sandwiched between a nip portion forming member and a fixing nip portion N of the elastic layer 110. The nip portion forming member is constituted by the heater substrate 105 (including the heaters H1 and H2) and the surface protective layer 107. While the recording material is conveyed, the recording material is subjected to heating and fixing processing.

An element 112, such as a thermo switch, is also provided on the reverse surface side of the heater substrate 105. The element 112 is operable when the heater temperature is abnormal to stop power supply to the heater line. Similar to the temperature detection element 111, the element 112 is brought into contact with the sheet passing area of the minimum-size paper. A metallic stay 104 can give a pressing force of a spring (not illustrated) to the holding member 101.

Figure 11:
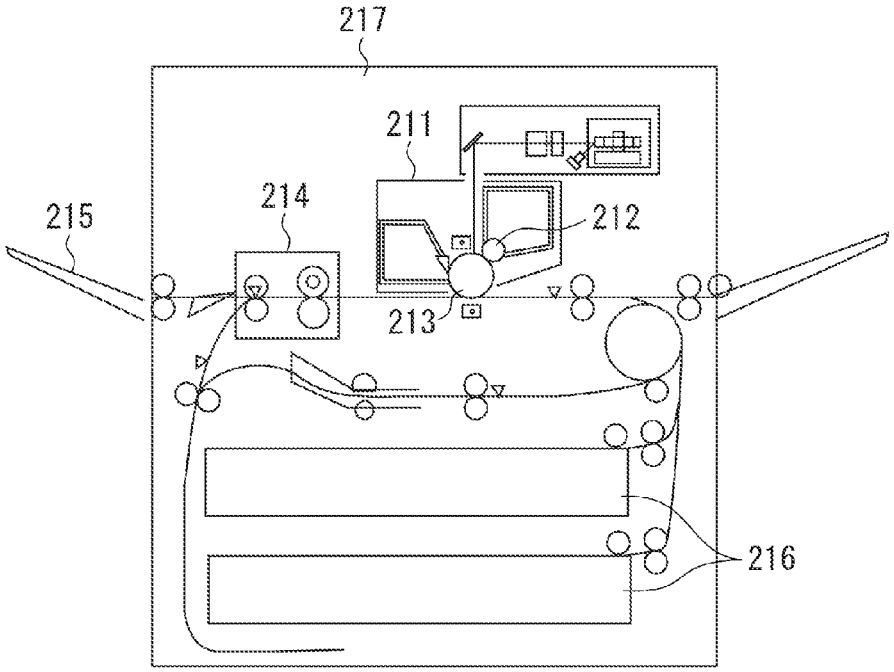
FIG. 11 is a schematic view illustrating an image forming apparatus that employs a heating apparatus according to an exemplary embodiment of the present invention.

The fixing apparatus 100 illustrated in FIG. 1 can be incorporated into an image forming apparatus, such as a copying machine, a laser beam printer, or a facsimile machine, to heat a recording material on which an image is formed and fix the image to the recording material. FIG. 11 illustrates a schematic configuration of a laser beam printer 217 [[see comments on page 1]], which is an example of the image forming apparatus. The laser beam printer 200 includes, as an image forming unit 210, a photosensitive drum 211 and a developing unit 212.

The image forming unit 210 is functionally operable as an image carrier on which a latent image can be formed. The developing unit 212 can develop a latent image formed on the photosensitive drum 211 with a toner. The toner image developed on the photosensitive drum 211 is then transferred onto a sheet (not illustrated), which is a recording medium that may be supplied from a cassette 216. The toner image transferred on the sheet is fixed by a fixing apparatus 214 and discharged to a tray 215.

Next, an exemplary embodiment of the image forming apparatus that incorporates the above-described fixing apparatus is described below in detail.

Figure 2A:
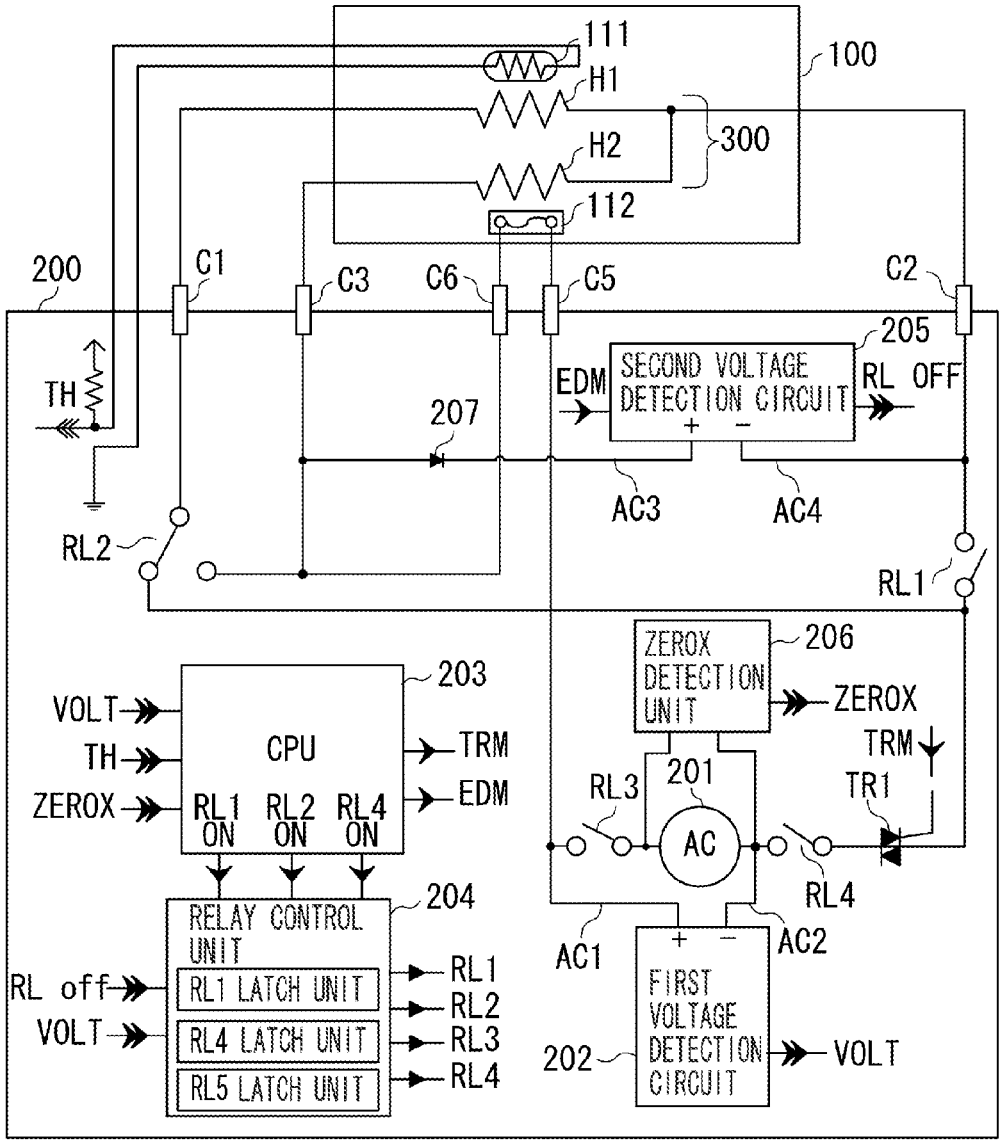
FIGS. 2A and 2B illustrate a configuration of a heater control circuit according to a first exemplary embodiment of the present invention.
Figure 2B:
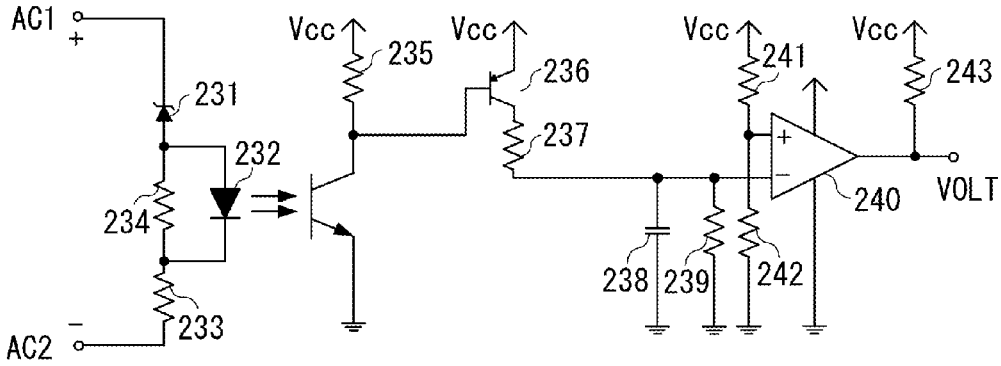

First, a first exemplary embodiment of the present invention is described below. FIGS. 2A and 2B illustrate a control circuit 200 [[see comments on page 1]] of the heater 300 according to the first exemplary embodiment. FIG. 2A illustrates a detailed circuit configuration of the control circuit 200. FIG. 2B illustrates a detailed circuit configuration of a first voltage detection circuit 202 (hereinafter, referred to as "voltage detection circuit 202"). The voltage detection circuit 202 is functionally operable as a commercial AC power source voltage detection circuit configured to determine whether the voltage of the commercial AC power source 201 is a first voltage (100 V) or a second voltage (200 V).

The control circuit 200 is described below in detail with reference to FIG. 2A. The control circuit 200 includes a plurality of connectors C1, C2, C3, C5, and C6 via which control circuit 200 can be connected to terminals of the fixing apparatus 100. The control circuit 200 includes the commercial AC power source 201 and a bidirectional thyristor TR1 (hereinafter, referred to as "TRIAC TR1") that can control electric power supply to the heater 300.

The TRIAC TR1 can perform an operation according to a TRM signal supplied from a central processing unit (CPU) 203 to drive the heater 300. The temperature detection element 111 measures a divided voltage component of a pull-up resistor as a temperature value. The CPU 203 receives a TH signal, which represents the detected temperature value, from the temperature detection element 111.

As internal processing, the CPU 203 calculates electric power to be supplied based on the temperature value detected by the temperature detection element 111 and a setting temperature of the heater 300, for example, according to the PI (proportional+integral) control. The CPU 203 converts the calculated electric power value into a phase angle (phase control) and a wave number (wave number control) to control the TRIAC TR1.

An example voltage detection unit and an example relay control unit are described below. The control circuit 200 illustrated in FIG. 2 includes a plurality of relay switches RL1, RL2, RL3, and RL4 respectively configured to switch a connection state between an ON state and an OFF state. FIG. 2 illustrates a contact connection state in which respective relay switches RL1, RL2, RL3, and RL4 are kept in a power OFF state.

The switch RL3 turns its operational state to ON when the heating apparatus becomes a standby state. The voltage detection circuit 202 detects a voltage value of the AC power source 201. The voltage detection circuit 202 determines whether the power source voltage is the 100V type (having the voltage range from 100 V to 127 V in the present exemplary embodiment) or the 200V type (having the voltage range from 200 V to 240 V in the present exemplary embodiment).

The voltage detection circuit 202 outputs a VOLT signal that represents a voltage detection result to the CPU 203 and the relay control unit 204. When the power source voltage is the 200V type (i.e., in the voltage range from 200 V to 240 V in the present exemplary embodiment), the voltage detection circuit 202 generates a LOW-state VOLT signal. A detailed configuration of the voltage detection circuit 202 is described below with reference to FIG. 2B.

When the voltage detection circuit 202 detects 200 V, the relay control unit 204 controls an RL1 latch unit to hold the relay RL1 in the OFF state. When the RL1 latch unit is operated, the relay RL1 remains in the OFF state even when the CPU 203 outputs a HIGH-level RL1ON signal.

As another example operation, the relay control unit 204 can hold the relay RL1 in the OFF state while the detected VOLT signal is in the LOW level, instead of using the above-described latch circuit.

The CPU 203 holds the relay RL2 in the OFF state according to the voltage detection result. Further, the CPU 203 turns the RL4ON signal into a HIGH level to change an operational state of the relay RL4 to ON. Electric power can be supplied to the fixing apparatus 100. In this state, the first conductive path H1 is connected in series to the second conductive path H2. Therefore, the heater 300 has a higher resistance value.

When the voltage detection circuit 202 detects 100 V, the CPU 203 turns the RL1ON signal into a HIGH level and the relay control unit 204 changes an operational state of the relay RL1 to ON. The CPU 203 turns an RL2ON signal into a HIGH level according to the VOLT signal to change an operational state of the relay RL2 to ON (i.e., a state where the movable connecting terminal is connected to a right hand contact). Further, the CPU 203 turns the RL4ON signal into a HIGH level to change an operational state of the relay RL4 to ON. Electric power can be supplied to the fixing apparatus 100. In this state, the first conductive path H1 is connected in parallel to the second conductive path H2. Therefore, the heater 300 has a lower resistance value.

The control circuit 200 further includes a second voltage detection circuit 205 (hereinafter, referred to as "voltage detection circuit 205"), which can detect a voltage value applied to the second conductive path H2. More specifically, the voltage detection circuit 205 detects a state where over-power is supplied to the heater 300 (see FIG. 3D).

If the state where over-power is supplied to the heater 300 is detected, the voltage detection circuit 205 outputs a LOW-level RLOFF signal to the relay control unit 204. The relay control unit 204 controls the RL1, RL3, and RL4 latch units to hold the relays RL1, RL3, and RL4 (i.e., a plurality of relays) in the OFF state to stop electric power supply to the fixing apparatus 100.

FIG. 2B illustrates a detailed circuit configuration of the voltage detection circuit 202. The circuit configuration illustrated in FIG. 2 is an example of the voltage detection unit according to the present exemplary embodiment. The voltage detection circuit 202 can determine whether the voltage applied between two terminals AC1 and AC2 is the 100V type (i.e., in the voltage range from 100 V to 127 V in the present exemplary embodiment) or the 200V type (i.e., in the voltage range from 200 V to 240 V in the present exemplary embodiment), as described below.

When the voltage applied between two terminals AC1 and AC2 is the 200V type, the voltage applied between the AC1 and AC2 terminals has a voltage value higher than a Zener voltage of the Zener diode 231 (i.e., an element capable of obtaining a constant voltage) and a measurable amount of current flows between the terminals AC1 and AC2.

The voltage detection circuit 202 includes a current limiting resistor 233, a photo-coupler 232, and a protective resistor 234 of the photo-coupler 232. If the current flows through a primary side light emitting diode of the photo-coupler 232, a secondary side transistor turns on and the current from the terminal Vcc flows via a resistor 235.

The gate voltage of a transistor 236 decreases to a LOW level, and the transistor 236 turns its operational state to ON. Then, the charging current flows from the terminal Vcc to a capacitor 238 via a resistor 237. The voltage detection circuit 202 further includes a discharge resistor 239.

If the rate of time (which is referred to as "ON Duty" or "ON time") during which the voltage applied between the AC1 and AC2 terminals exceeds the Zener voltage of the Zener diode 231 becomes greater, the ON time rate of the transistor 236 becomes greater. If the ON time rate of the transistor 236 becomes greater, the time during which the charging current flows from the terminal Vcc via the resistor 237 becomes longer. Therefore, the capacitor 238 has a higher voltage value.

If the voltage value of the capacitor 238 becomes greater than a comparison voltage (i.e., a threshold voltage) of a comparator 240, the current from the terminal Vcc flows via a resistor 243 to an output terminal of the comparator 240. The voltage level of the output terminal turns into a LOW level. The comparison voltage of the comparator 240 is equal to the voltage of a division point between a resistor 241 and a resistor 242.

In the first exemplary embodiment, instead of using the circuit illustrated in FIG. 2B, the CPU 203 can calculate a rate of time during which the voltage applied between the AC1 and AC2 terminals exceeds the Zener voltage of the Zener diode 231.

Figure 3A:
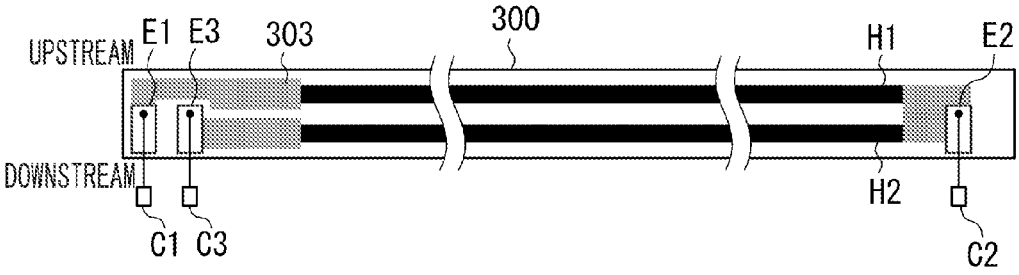
FIGS. 3A, 3B, 3C, and 3D illustrate an example configuration of a heater and heater conductive paths according to the first exemplary embodiment of the present invention.
Figure 3B:
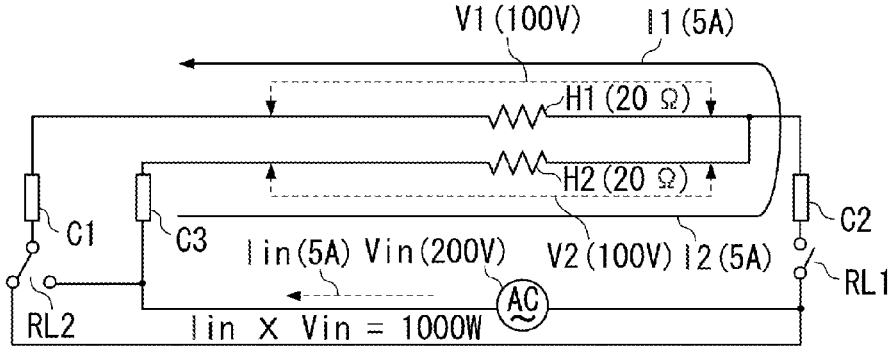
Figure 3C:
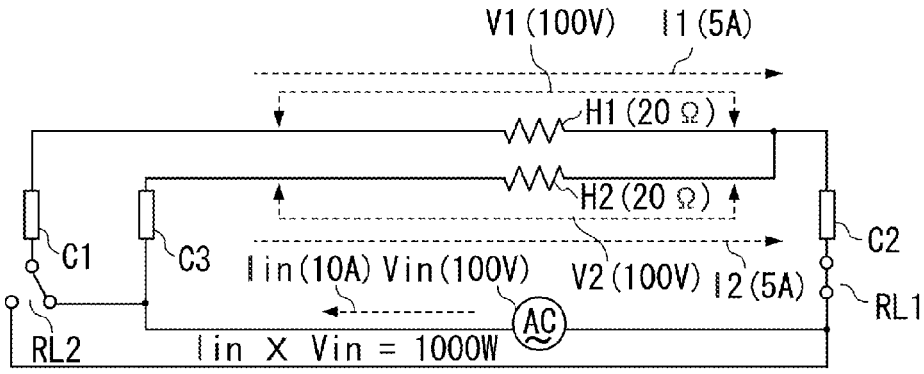

FIGS. 3A to 3C schematically illustrate the heater 300 and the conductive paths H1 and H2 of the heater 300 according to the first exemplary embodiment. FIG. 3A illustrates a heat generation pattern, a conductive pattern, and electrodes formed on the substrate 105. Further, the heater configuration illustrated in FIG. 3A includes connection portions to be connected to the connectors of the control circuit 200 illustrated in FIG. 2.

The heater 300 includes a resistance heating pattern, which constitutes the conductive paths 111 and 112, and a conductive pattern 303. Electric power can be supplied to the first conductive path 111 of the heater 300 via a first electrode E1 and a second electrode E2. Further, electric power can be supplied to the second conductive path 112 via the second electrode E2 and a third electrode E3. The first electrode E1 is connected to the connector C1. The second electrode E2 is connected to the connector C2. The third electrode E3 is connected to the connector C3.

Figure 3D:
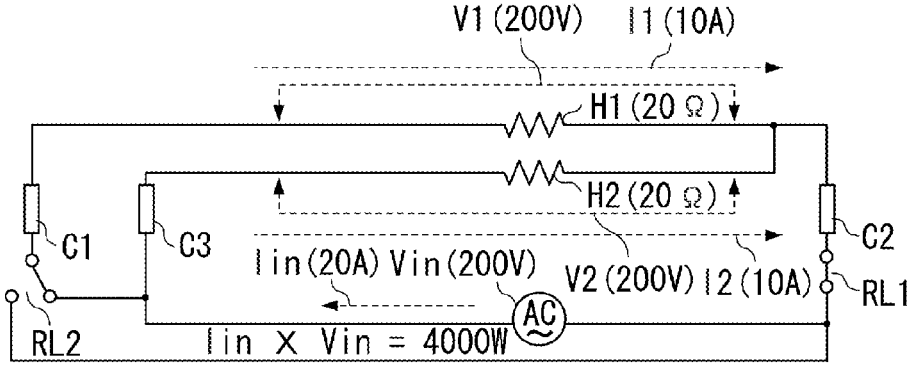

Further, in FIGS. 3B to 3D, the relay RL1 is functionally operable as a first switch and the relay RL2 is functionally operable as a second switch, which can cooperatively switch a connection state between the conductive paths H1 and H2.

Further, the relay RL1 switches a connection state between a second power terminal side of the commercial AC power source and the second electrode E2. The relay RL2 connects the conductive paths H1 and H2 in series or in parallel to a first power terminal side of the commercial AC power source. For example, the relay RL1 is a make contact (always open contact) relay or a break contact (always closed contact) relay. The relay RL2 is a break-before-make contact (BBM contact) relay.

FIG. 3B illustrates a conductive path of the heater 300 in a first operational state where the first conductive path H1 is connected in series to the second conductive path H2 when the voltage of the commercial AC power source is 200 V. In the present exemplary embodiment, it is presumed that each of the first conductive path H1 and the second conductive path H2 has a resistance value of 20 Ω.

In the first operational state, two resistors of 20Ω are connected in series to each other. Therefore, the heater 300 has a composite resistance value of 40Ω. As the power source voltage is 200 V, the current supplied to the heater 300 is 5 A and the electric power supplied to the heater 300 is 1000 W. In this case, a current I1 flowing through the first conductive path H1 and a current I2 flowing through the second conductive path H2 are 5 A, respectively. Further, a voltage V1 applied across the first conductive path H1 and a voltage V2 applied across the second conductive path H2 are 100 V, respectively.

FIG. 3C illustrates a conductive path of the heater 300 in a second operational state where the first conductive path H1 is connected in parallel to the second conductive path H2 when the voltage of the commercial AC power source is 100 V. In the second operational state, two resistors of 20Ω are connected in parallel to each other. Therefore, the heater 300 has a composite resistance value of 10Ω. As the power source voltage is 100 V, the current supplied to the heater 300 is 10 A and the electric power supplied to the heater 300 is 1000 W. In this case, the current I1 flowing through the first conductive path H1 and the current I2 flowing through the second conductive path H2 are 5 A, respectively. Further, the voltage V1 applied across the first conductive path H1 and the voltage V2 applied across the second conductive path H2 are 100 V, respectively.

Hereinafter, practical values of the current, the voltage, and the electric power supplied to the heater are compared with reference to the states illustrated in FIG. 3B and FIG. 3C. When the voltage V1 or the voltage V2 is detected in the state illustrated in FIG. 3B, the current value is 5 A and the electric power supplied to the heater is 1000 W. In the state illustrated in FIG. 3C, the current value is 5 A and the electric power supplied to the heater is 1000 W.

When the current I1 or the current I2 is detected in the state illustrated in FIG. 3B, the voltage value is 100 V and the electric power supplied to the heater is 1000 W. In the state illustrated in FIG. 3C, the voltage value is 100 V and the electric power supplied to the heater is 1000 W.

As described above, the detected voltage (V1 or V2) and the detected current (I1 or I2) are values proportional to the electric power supplied to the heater 300 regardless of switching of the operational state of the heater 300 between the first operational state and the second operational state.

FIG. 3D schematically illustrates a conductive path in a case where the heater 300 fails. In FIG. 3D, the power source voltage is 200 V and the heater 300 is in the second operational state (in which a heater resistance value is low). In the second operational state, the composite resistance value of the heater 300 is 10 Ω.

As the power source voltage is 200 V, the current supplied to the heater 300 is 20 A and the electric power supplied to the heater 300 is 4000 W. The amount of the electric power supplied to the heater 300 in the above-described failure state is excessively larger, compared to that in the normal state. Therefore, it is required to detect the failure state illustrated in FIG. 3D.

In the normal state, as described above with reference to FIG. 3B and FIG. 3C, each of the current I1 and the current I2 is 5 A and each of the voltage V1 and the voltage V2 is 100 V.

On the other hand, in the failure state illustrated in FIG. 3D, the current I1 flowing through the first conductive path is 10 A and the voltage V1 applied across the first conductive path is 200 V. The current I2 flowing through the second conductive path is 10 A and the voltage V2 applied across the second conductive path is 200 V.

More specifically, the values of the current (I1, I2) and the voltage (V1, V2) in the failure state become two times the normal values in the first conductive path H1 or in the second conductive path H2. Therefore, the control circuit 200 can detect an abnormal state by checking if the current (I1, I2) and the voltage (V1, V2) are two times the normal values. In the state illustrated in FIG. 3D, the voltage detection circuit 205 illustrated in FIG. 2 detects the voltage V1 and voltage V2 applied across the conductive paths.

In the state illustrated in FIG. 3D, even when the operational state of the relay RL2 turns into OFF (i.e., a state where the movable connecting terminal is connected to a left hand contact), the current supplied to the heater 300 is 10 A and the electric power is 2000 W. In this state, the current and the voltage are applied to only the second conductive path H2. It is required to measure the voltage V2 to detect a state where a large amount of electric power is supplied to the heater 300. In the state illustrated in FIG. 3D, if the operational state of the relay RL2 is OFF, the voltage detection circuit 205 illustrated in FIG. 2 detects the voltage V2 applied across the conductive path H2.

In the state illustrated in FIG. 3D, if any open failure occurs in the path of the connector C3, the current supplied to the heater 300 is 10 A and the electric power is 2000 W. In this case, the current and the voltage are applied to only the first conductive path. Therefore, it is required to measure the voltage V1 to detect the state where a large amount of electric power is supplied to the heater 300. In the state illustrated in FIG. 3D, if any open failure occurs in the path of the connector C3, the voltage detection circuit 205 illustrated in FIG. 2 detects the voltage V1 applied to the conductive path H1.

Figure 4A:
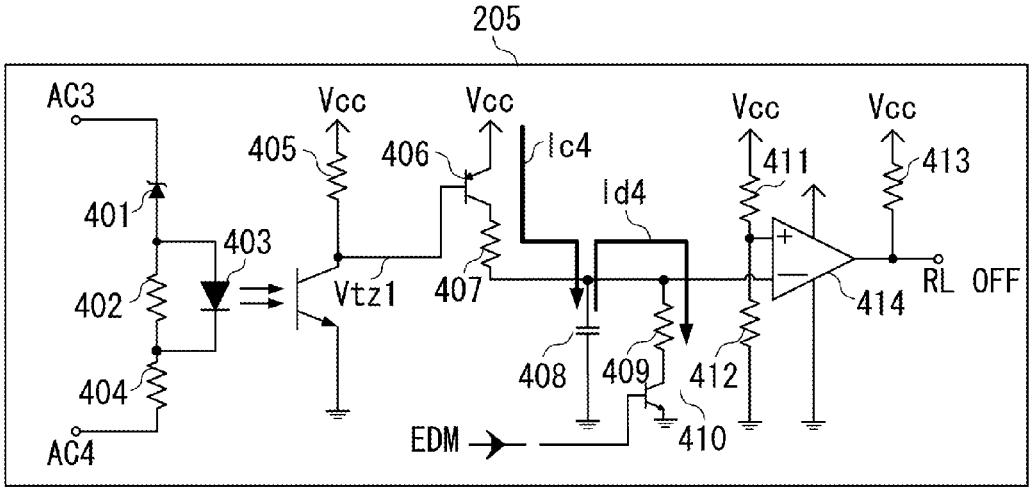
FIGS. 4A and 4B illustrate a configuration and an operation of a voltage detection circuit according to the first exemplary embodiment of the present invention.
Figure 4B:
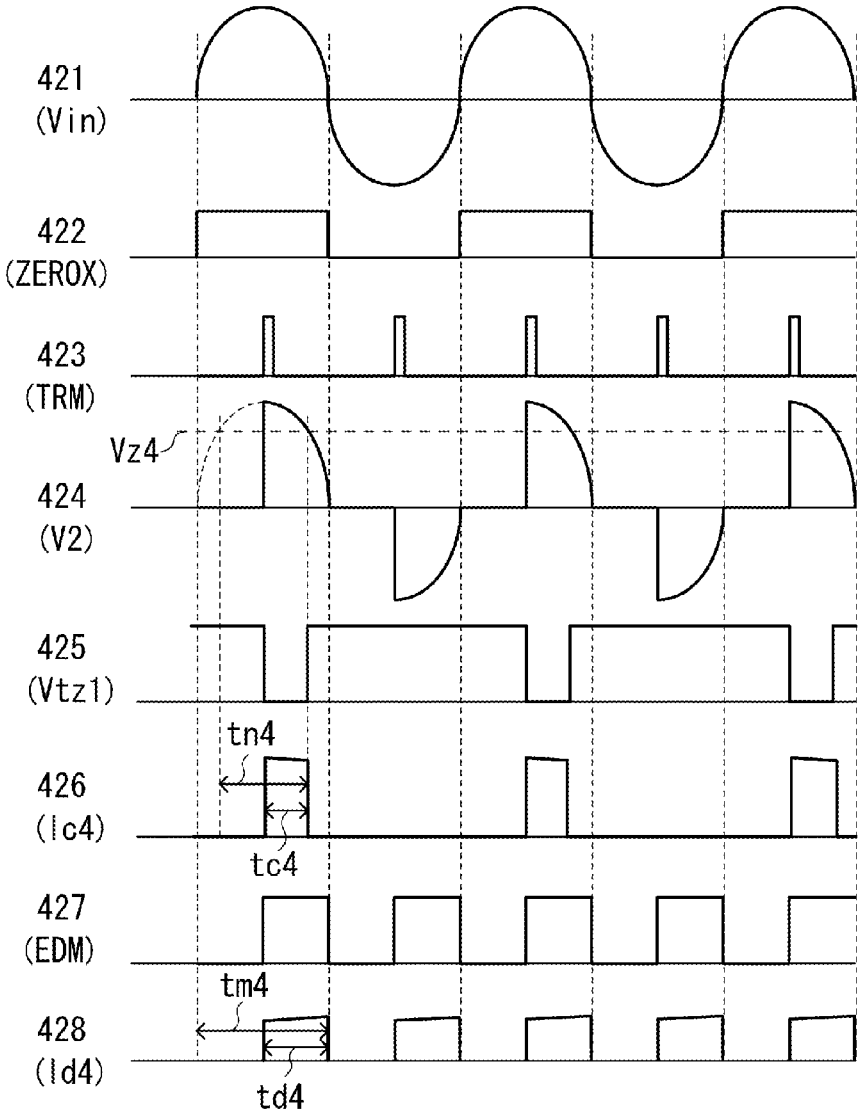

FIGS. 4A and 4B illustrate a circuit and operation waveforms of the voltage detection circuit 205 employed in the first exemplary embodiment. More specifically, FIG. 4A illustrates an example configuration of the voltage detection circuit 205. FIG. 4B illustrates waveforms of various signals in an example operation that can be performed by the voltage detection circuit 205.

A circuit configuration of the voltage detection circuit 205 is described below with reference to FIGS. 4A and 4B. If the voltage applied between terminals AC3 and AC4 is higher than a Zener voltage of a Zener diode 401, the current flows between the terminals AC3 and AC4. If the current flows through a primary side light emitting diode of a photo-coupler 403, a secondary side transistor turns on and the gate voltage of the transistor 406 decreases to a LOW level. The voltage detection circuit 205 illustrated in FIG. 4A includes a current limiting resistor 404 and a protective resistor 402 of the photo-coupler 403.

If the transistor 406 turns on, a charging current Ic4 flows from a terminal Vcc to a capacitor 408 via a resistor 407. A discharge current Id4 of the capacitor flows to a ground (GND) terminal via a resistor 409 and a transistor 410. The CPU 203 supplies an EDM signal to a gate terminal of the transistor 410. If the EDM signal turns into a HIGH level, the transistor 410 turns its operational state to ON and therefore the discharge current Id4 flows. If the EDM signal turns into a LOW level, the transistor 410 turns into the OFF state thereof and therefore the discharge current Id4 does not flow.

In the capacitor 408, if a ratio of a period of time during which the charging current Ic4 flows to a period of time during which the discharge current Id4 flows increases (i.e., if a charging time becomes longer), a saturation voltage of the capacitor 408 becomes a higher value. If the voltage of the capacitor 408 becomes greater than a comparison voltage (i.e., a threshold voltage) of a comparator 414, the current from the terminal Vcc flows via a resistor 413 to an output terminal of the comparator 414. The voltage level of an output terminal RLOFF turns into a LOW level. Thus, it is feasible to detect a higher voltage state. The comparison voltage of the comparator 414 is equal to the voltage of a division point between a resistor 411 and a resistor 412. The above-described rate can be set beforehand according to the saturation voltage of the capacitor.

FIG. 4B illustrates waveforms of various signals in an example operation that can be performed by the voltage detection circuit 205. In FIG. 4B, a waveform 421 represents an AC input voltage of the power source 201. A ZEROX detection unit 206 generates a ZEROX signal 422 based on the AC input voltage waveform 421. The ZEROX signal 422 is usable for a zero cross detection of the commercial AC power source 201.

The ZEROX signal 422 is in a HIGH level during a period of time that corresponds to a positive half-wave of the AC input voltage waveform 421 and turns into a LOW level during a period of time that corresponds to a negative half-wave. A waveform 423 represents a TRIAC operation control signal (i.e., TRM signal), which can be supplied to the TRIAC TR1 to control electric power supplied to a heat generation portion.

If the TRM signal 423 turns into a HIGH level, the TRIAC TR1 turns its operational state to ON. The TRIAC remains in the ON state until the signal crosses the zero point. A solid line of a waveform 424 represents the voltage V2 applied across the second conductive path H2.

The waveform 424 illustrated in FIG. 4B represents the voltage V2 in a 50% DUTY control, i.e., in a state where the electric power supplied to the heater 300 is controlled to be 50%, which can be referred to as "phase control."

The voltage having the waveform 424 is input to the voltage detection circuit 205 via a diode 207. A waveform 425 represents a gate voltage (Vtz1) of the transistor 406, which turns into a LOW level in a period of time during which the voltage V (the waveform 424) applied across the second conductive path H2 exceeds a Zener voltage Vz4 of the Zener diode 401.

If the gate voltage (Vtz1) turns into a LOW level, the transistor 406 turns on. The charging current Ic4 flows from the terminal Vcc to the capacitor 408 via the resistor 407. A waveform 426 represents the charging current Ic4. The time of the charging current Ic4 is referred to as a first period during which the voltage applied to the heater 300 (H1 or H2) exceeds the comparison voltage (i.e., the threshold voltage).

A waveform 427 represents an EDM signal that can be generated by the CPU 203. If the TRM signal turns into a HIGH level, the EDM signal holds the HIGH level until the zero cross signal 422 changes its state. More specifically, the EDM signal is in a HIGH level when the operational state of the TRIAC is ON. The EDM signal is in a LOW level when the operational state of the TRIAC is OFF. Therefore, the EDM signal 427 remains in the high state in a period of time during which the voltage is applied across the second conductive path H2 (see the waveform 424).

If the EDM signal is input to the base terminal of the transistor 410 of the voltage detection circuit 205, the discharge current Id4 flows only in a period of time during which the voltage is applied across the second conductive path H2. A waveform 428 represents the discharge current Id4. The time of the discharge current Id4 is referred to as a second period during which the electric power is supplied to the heater 300 (H1 or H2).

In a case where the electric power supplied to the heater 300 is controlled to be 100%, the charging current Ic4 flows during a time period tn4. In a case where the electric power supplied to the heater 300 is controlled to be 50%, the charging current Ic4 flows during a time period tc4. The charging time tc4 is approximately a half of the charging time tn4.

On the other hand, when the electric power supplied to the heater 300 is controlled to be 100%, the discharge current Id4 flows during a time period tm4. Further, when the electric power supplied to the heater 300 is controlled to be 50%, the discharge current Id4 flows during a time period td4. The discharge time td4 is approximately a half of the discharge time tm4.

If a ratio of the charging time to the discharge time decreases, the saturation voltage of the capacitor 408 decreases and a higher voltage state may not be detected. In the voltage detection circuit 205 according to the present exemplary embodiment, if the electric power is supplied to the heater 300 at the rate of 50%, the charging time tc4 becomes a half level of the charging time tn4 and the discharge time td4 becomes a half level of the charging time tm4. Accordingly, the ratio of the charging time td4 to the discharge time tc4 is not different from the ratio of the charging time tm4 to the discharge time tn4 in the state where the electric power supplied to the heater 300 is controlled to be 100%.

More specifically, when the voltage detection circuit 205 is employed, the above-described ratio of the second period (tm4, td4) to the first period (tn4, tc4) reduces the influence of the electric power control performed by the TRIAC TR1. Thus, it becomes feasible to detect the failure state, i.e., the over-power supply state illustrated in FIG. 3D.

In the present exemplary embodiment, the control circuit 200 detects any over-power supply state by checking the above-described ratio of the second period to the first period. However, it is also useful to obtain a difference value between the first period and the second period. In this case, the control circuit 200 can check if an obtained difference value is equal to or less than a predetermined value to identify any over-power supply state.

The present exemplary embodiment is characterized by identifying the above-described over-power supply state based on the first period and the second period. The voltage detection circuit 205 can determine whether the electric power supplied to the heater is excessive based on the ratio or the difference obtainable from the first and second periods.

FIGS. 5A to 5D illustrates some simulation results, which indicate that the voltage detection circuit 205 according to the present exemplary embodiment can detect the failure state illustrated in FIG. 3D even in a state where the phase control is performed to control the electric power to be supplied to the heater 300 as indicated by the waveform 424.

FIGS. 5A to 5D illustrate detailed simulation results, with respect to TRIAC TR1 ON time rate, electric power supplied to the heater, saturation voltage of the capacitor 408 in the voltage detection circuit 205, and voltage detection result, in the phase control.

FIG. 5A illustrates a detection result obtained by the voltage detection circuit 205 according to the present exemplary embodiment. The comparison voltage (i.e., the threshold voltage) of the comparator 414 having been set in the simulation was 2 V. According to the simulation result illustrated in FIG. 5A, if the saturation voltage of the capacitor 408 exceeds 2 V, the RLOFF signal turns into a LOW level. Therefore, the voltage detection circuit 205 can detect the failure state illustrated in FIG. 3D.

In a case where the TRIAC TR1 ON time rate is 100%, the voltage applied across the second conductive path H2 in the failure state illustrated in FIG. 3D is 200 V. The voltage applied to the capacitor 408 of the voltage detection circuit 205 is 2.44 V. In this case, the voltage applied to the capacitor 408 is higher than the comparison voltage (2 V) of the comparator 414. Therefore, the output RLOFF of the voltage detection circuit 205 turns into its LOW level. Thus, the voltage detection circuit 205 can detect the failure state illustrated in FIG. 3D.

If the TRIAC TR1 ON time rate changes from 100% to 25%, the voltage applied to the capacitor 408 becomes higher than the comparison voltage of the comparator 414 because the discharge time is controlled according to an operation time of the TRIAC. Thus, the voltage detection circuit 205 can detect the failure state illustrated in FIG. 3D.

If the TRIAC TR1 ON time rate becomes equal to or less than 25%, the period of time during which the voltage V2 (the waveform 424) exceeds the Zener voltage Vz4 becomes very small. Therefore, the period of time during which the voltage V (the waveform 424) applied across the second conductive path 112 exceeds the Zener voltage Vz4 of the Zener diode 401. The output RLOFF of the voltage detection circuit 205 turns into a High state. The voltage detection circuit 205 cannot detect the failure state illustrated in FIG. 3D.

However, the electric power supplied to the heater 300 is limited to 1000 W or less. As the electric power supplied to the heater is small, conventionally available elements, such as the temperature detection element 111 and the element 112 (e.g., a temperature fuse or a thermo SW), can be used to stop the electric power supply to the heater 300.

On the other hand, FIG. 5B illustrates a detection result obtained when the EDM signal constantly remains in the HIGH level (i.e., a state where the discharge current Id4 constantly flows) and the discharge current Id4 is not controlled. When the TRIAC TR1 ON time rate is 100%, similar to FIG. 5A, the saturation voltage of the capacitor 408 is higher than the comparison voltage of the comparator 414. Therefore, the output RLOFF of the voltage detection circuit 205 turns into its LOW level. Therefore, the voltage detection circuit 205 can detect the failure state illustrated in FIG. 3D.

When the TRIAC TR1 ON time rate is equal to or less than 100%, the saturation voltage of the capacitor 408 decreases because a ratio of a period of time during which the discharge current Id4 flows to a period of time during which the charging current Ic4 flows into the capacitor 408 decreases in response to a decrease of the TRIAC TR1 ON time rate. Therefore, if the TRIAC TR1 ON time rate becomes smaller than 50%, the saturation voltage of the capacitor 408 becomes 1.93 V (i.e., a value less than the comparison voltage of the comparator 414). Accordingly, the voltage detection circuit 205 cannot detect the failure state illustrated in FIG. 3D. In this case, the electric power supplied to the heater 300 becomes a maximum value (2000 W).

In a case where the discharge current is not controlled, the voltage detection circuit 205 may not be able to detect any failure state even when the electric power supplied to the heater becomes approximately two times the value in the case where the voltage detection circuit 205 according to the present exemplary embodiment is used.

More specifically, if the configuration of the fixing apparatus 100 is inappropriate, the conventionally available elements, such as the temperature detection element 111 and the element 112 (e.g., a temperature fuse or a thermo SW) may not be used to stop the electric power supply to the heater 300.

Figure 5C:
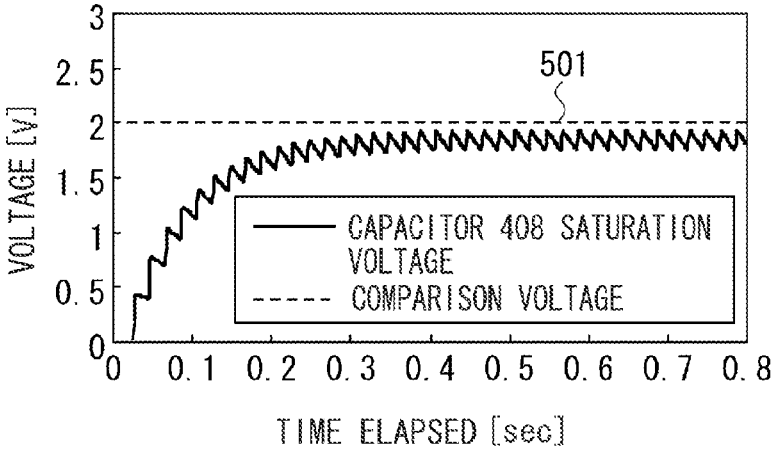
Figure 5D:
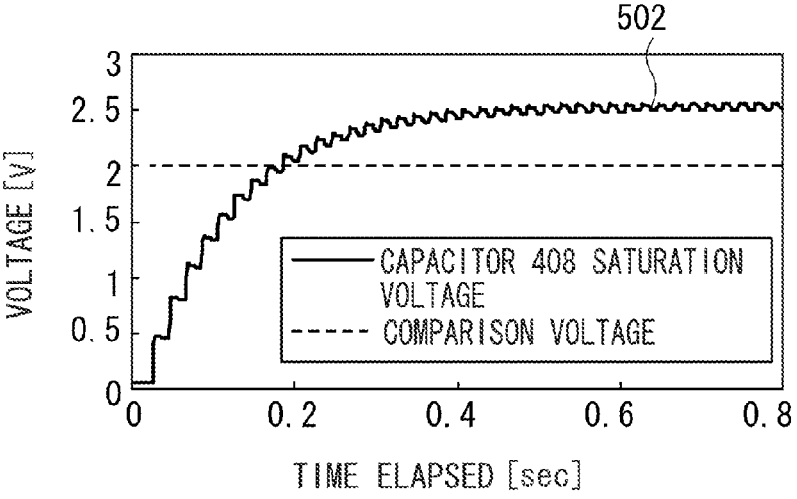

FIG. 5C is a graph illustrating a waveform 501 representing the saturation voltage of the capacitor 408 in a case where the discharge current is not controlled although the phase control is performed to set the electric power to 50%. FIG. 5D is a graph illustrating a waveform 502 representing the saturation voltage of the capacitor 408 according to the present exemplary embodiment in a case where the phase control is performed to control the electric power to 50%.

FIG. 5C and FIG. 5D illustrate simulation results obtained in the phase control performed to set the TRIAC TR1 ON time rate to 50%. In each graph of FIGS. 5C and 5D, a solid line indicates the saturation voltage. When the saturation voltage exceeds the comparison voltage (indicated by a dotted line) of the comparator 414, the voltage detection circuit 205 can detect the failure state illustrated in FIG. 3D.

The above-described discharge current control performed by the voltage detection circuit 205 according to the present exemplary embodiment is useful to reduce the influence of the electric power control performed by the TRIAC TR1. Thus, the voltage detection circuit according to the present exemplary embodiment can detect the failure state illustrated in FIG. 3D.

Figure 6:
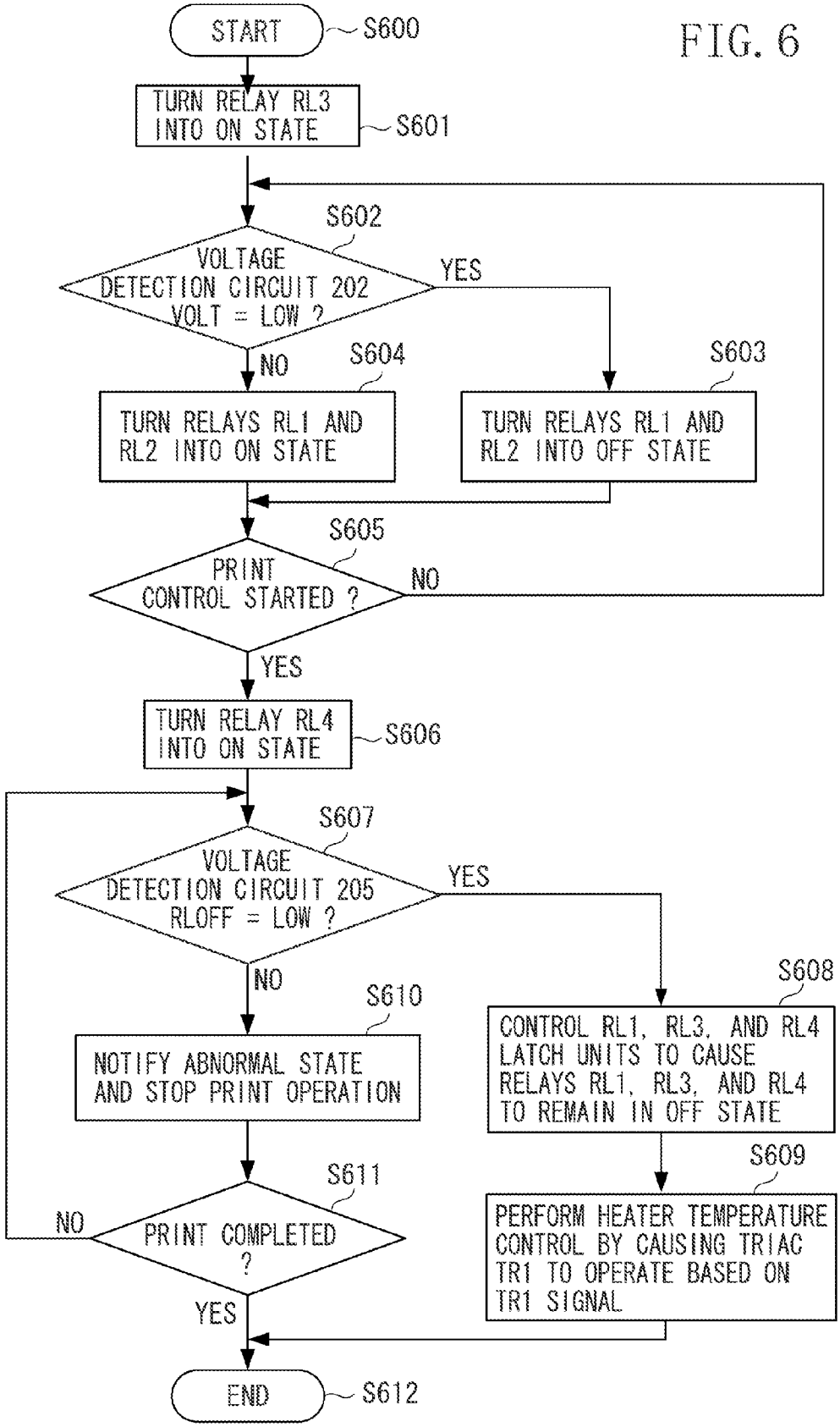
FIG. 6 is a flowchart illustrating a control sequence according to the first exemplary embodiment of the present invention.

FIG. 6 is a flowchart illustrating a control sequence of the fixing apparatus 100, which can be performed by the CPU 203 and the relay control unit 204 according to the first exemplary embodiment. In step S600, the CPU 203 starts the control when the control circuit 200 is in a standby state and the processing proceeds to step S601. In step S601, the CPU 203 causes the relay control unit 204 to change the operational state of the relay RL3 to ON. In step S602, the CPU 203 identifies the voltage range of the power source based on the VOLT signal (i.e., an output of the voltage detection circuit 202).

If the CPU 203 determines that the power source voltage is the 100V type (when the power source voltage is in the voltage range from 100 V to 127 V in the present exemplary embodiment), the processing proceeds to step S604. If the CPU 203 determines that the power source voltage is the 200V type (when the power source voltage is in the voltage range from 200 V to 240 V in the present exemplary embodiment), the processing proceeds to step S603.

In step S603, the CPU 203 controls the relay control unit 204 to cause two relays RL1 and RL2 to remain in the OFF state thereof. Then, the processing proceeds to step S605. In step S604, the CPU 203 controls the relay control unit 204 to change the operational state of the relays RL1 and RL2 to ON. Then, the processing proceeds to step S605. In step S605, the CPU 203 determines whether a print control has been started. The CPU 203 repeats the processing of step S602 to step S604 until a determination result in step S605 turns into YES.

If it is determined that the print control has been already started (YES in step S605), the processing proceeds to step S606. In step S606, the CPU 203 turns the RL4ON signal (i.e., the signal to be output to the relay control unit 204) into a HIGH level and controls the relay control unit 204 to change the operational state of the relay RL4 to ON.

In step S607, the CPU 203 determines whether the RLOFF signal is in its LOW level. If the voltage detection circuit 205 has detected the failure state illustrated in FIG. 3D, the RLOFF signal turns into the LOW level (YES in step S607). Then, the processing proceeds to step S608. In step S608, the relay control unit 204 controls the RL1, RL3, and RL4 latch units to cause the relays RL1, RL3, and the RL4 to remain in their OFF states. Then, the processing proceeds to step S609.

In step S609, the CPU 203 notifies the occurrence of an abnormal state and immediately stops the print operation. Then, the processing proceeds to step S612 to terminate the control processing according to the flowchart illustrated in FIG. 6. If no abnormal state is detected (NO in step S607), the processing proceeds to step S610. In step S610, the CPU 203 performs an electric power supply control (i.e., a phase control or a wave number control) for the heater 300 by controlling the TRIAC TR1, based on the TH signal output from the temperature detection element 111, using the PI control.

In step S611, the CPU 203 determines whether the print operation has been completed. If it is determined that the print operation is not yet completed (NO in step S611), the CPU 203 repeats the processing of step S607 to step S611. If it is determined that the print operation has been completed (YES in step S611), the processing proceeds to step S612 to terminate the control processing according to the flowchart illustrated in FIG. 6.

In the above-described exemplary embodiment, the Zener diode 401 determines the comparison voltage (i.e., the threshold voltage) of the voltage detection circuit 205. Alternatively, a shunt regulator is usable as an element capable of obtaining a constant voltage to set the comparison voltage.

As described above, when the voltage detection circuit 205 according to the first exemplary embodiment is employed, the voltage detection circuit 205 can surely detect a state where electric power is excessively supplied to the heat generation portion in an apparatus capable of switching a resistance value.

Next, a second exemplary embodiment of the present invention is described below. FIG. 7 illustrates a control circuit 700 of a heater 800 according to the second exemplary embodiment. A description for a configuration similar to that described in the first exemplary embodiment is not repeated.

Figure 7A:
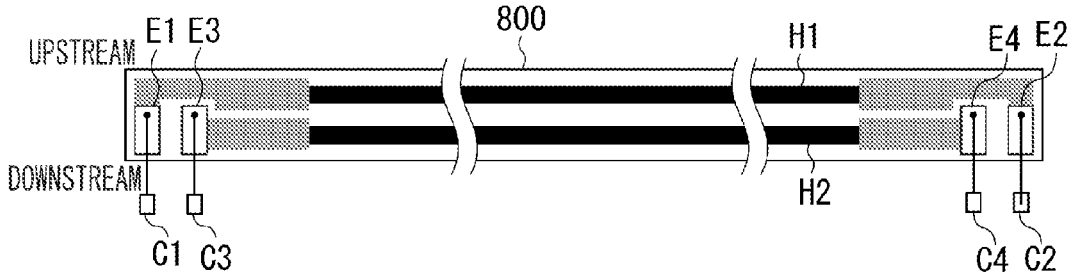
FIGS. 7A and 7B illustrate a configuration of a heater control circuit according to a second exemplary embodiment of the present invention.

FIG. 7A illustrates a heat generation pattern, a conductive pattern, and electrodes formed on the substrate 105. Further, the heater configuration illustrated in FIG. 7A includes connection portions to be connected to the connectors of the control circuit 200 illustrated in FIG. 2. The heater 800 includes a resistance heating pattern, which constitutes two conductive paths H1 and H2 formed thereon. Electric power can be supplied to the first conductive path H1 of the heater 800 via a first electrode E1 and a second electrode E2. Further, electric power can be supplied to the second conductive path H2 via a third electrode E3 and a fourth electrode E4.

The first electrode E1 is connected to the connector C1. The second electrode E2 is connected to the connector C2. The third electrode E3 is connected to the connector C3. The electrode E4 is connected to the connector C4. Further, in FIG. 7B, the relay RL1 is functionally operable as the first switch and the relay RL2 is functionally operable as the second switch, which can cooperatively switch a connection state between the conductive paths H1 and H2. For example, the relay RL1 and the relay RL2 are break-before-make contact (BBM contact) relays.

Figure 7B:
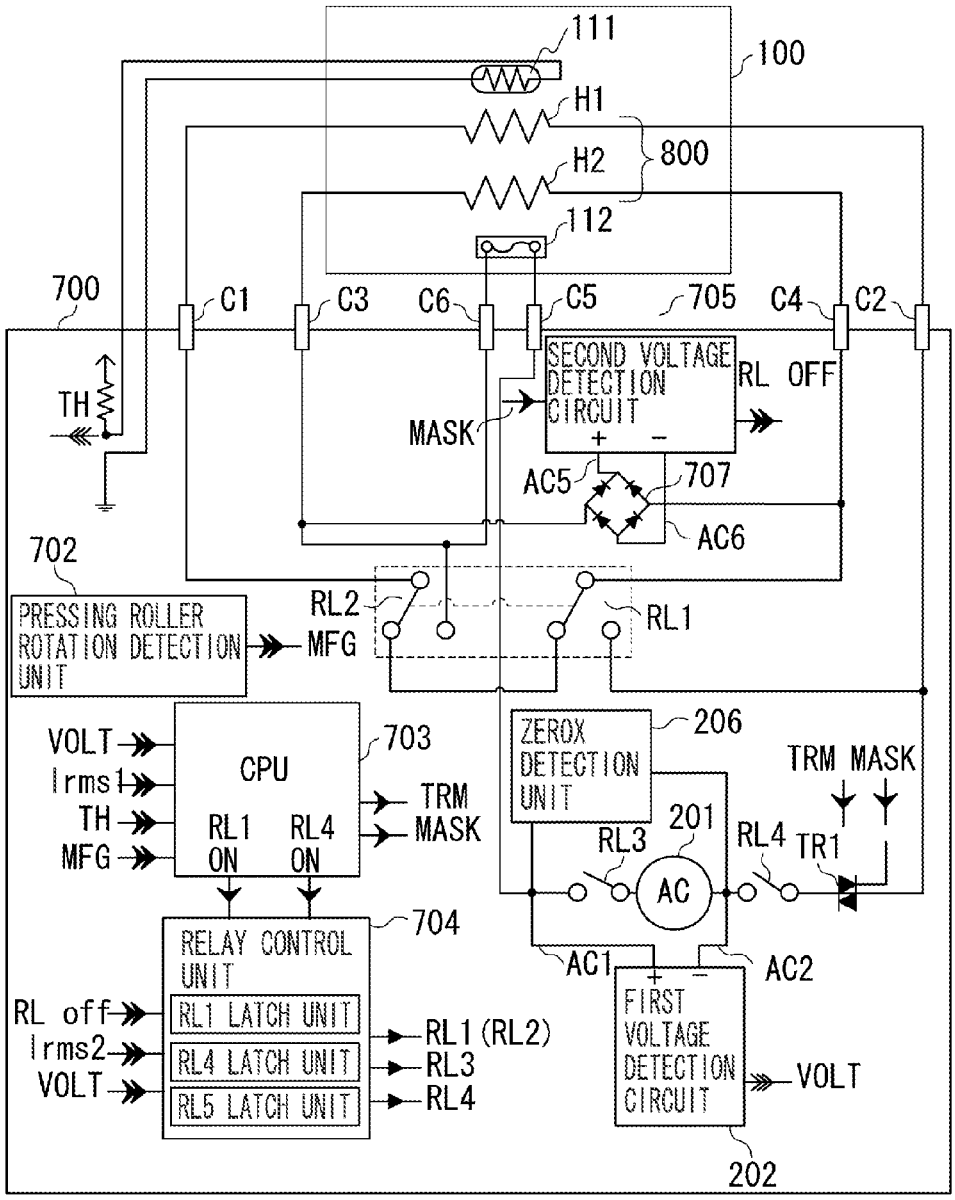

The TRIAC TR1 illustrated in FIG. 7B is operable according to a TRM signal and a MASK signal supplied from a CPU 703. A pressing roller rotation detection unit 702 is configured to prevent a large amount of electric power from being supplied in a non-rotational state of the pressing roller 108. The pressing roller rotation detection unit 702 generates a LOW-level MFG signal if a rotational state of the pressing roller 108 is detected. The pressing roller rotation detection unit 702 generates a HIGH-level MFG signal if a non-rotational state of the pressing roller 108 is detected.

If the MFG signal indicates that the pressing roller 108 is in a non-rotational state, the CPU 703 generates the MASK signal to limit the electric power supplied to the heater 800. If the MFG signal is in the LOW level (when the pressing roller 108 is rotating), the MASK signal remains in the LOW level. If the MFG signal is in the HIGH level (when the pressing roller 108 is not rotating), the MASK signal has a pulse waveform (see a waveform 833 illustrated in FIG. 8) whose signal level alternately changes between HIGH and LOW every two consecutive periods of the AC power source.

In the above-described first exemplary embodiment, the voltage detection circuit 205 detects a positive half-wave voltage of the voltage V2 applied across the second conductive path H2. In the present exemplary embodiment, the control circuit 700 illustrated in FIG. 7B includes a voltage detection circuit 705 associated with a bridge diode 707, which can detect a full-wave (i.e., a positive half-wave and a negative half-wave) of the voltage V2 (see waveform 834).

In a contact connection state illustrated in FIG. 7B, respective relays RL1, RL2, RL3, and RL4 are in a power OFF state. If the voltage detection circuit 202 detects 200 V, a relay control unit 704 controls an RL1 latch unit to hold the relay RL1 in the OFF state. The relay RL2 is switchable in synchronization with the relay RL1. Therefore, the relay RL1 and the relay RL2 simultaneously turn into the OFF state.

Further, when the relay RL4 turns its operational state to ON, electric power can be supplied to the fixing apparatus 100. In this state, the first conductive path H1 is connected in series to the second conductive path H2. Therefore, the heater 800 has a higher resistance value.

If the voltage detection circuit 202 detects 100 V, the relay RL1 turns its operational state to ON. As the relay RL2 is switchable in synchronization with the relay RL1, the relay RL2 and the relay RL1 simultaneously turn into the ON state. Further, when the relay RL4 turns its operational state to ON, electric power can be supplied to the fixing apparatus 100. In this state, the first conductive path H1 is connected in parallel to the second conductive path H2. Therefore, the heater 800 has a lower resistance value.

Figure 10:
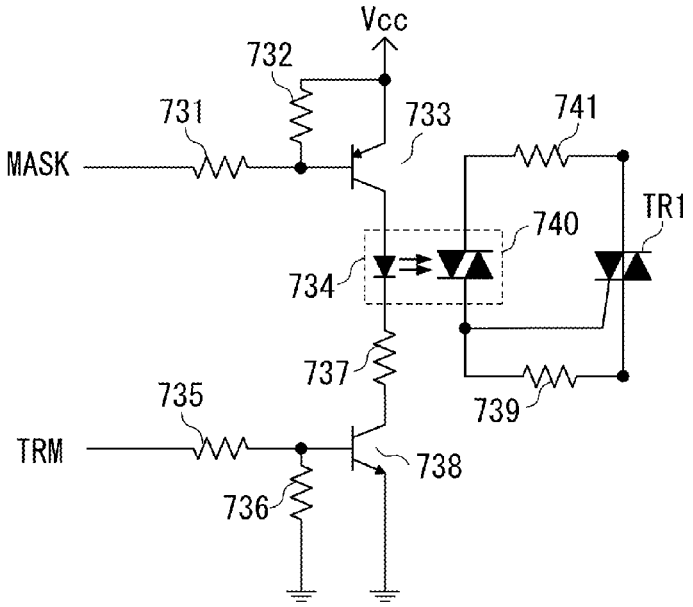
FIG. 10 illustrates a TRIAC driving circuit according to an exemplary embodiment of the present invention.

FIG. 10 illustrates an example driving circuit of the TRIAC TR1. If the MASK signal turns into a LOW level, the current flows into a base terminal of a PNP transistor 733 and the transistor 733 turns its operational state to ON. The driving circuit illustrated in FIG. 10 includes two resistors 731 and 732 that can be used to drive the transistor 733. If the TRM signal turns into a HIGH level, the current flows into a base terminal of a NPN transistor 738 and the transistor 738 turns its operational state to ON.

The driving circuit illustrated in FIG. 10 includes two resistors 735 and 736 that can be used to drive the transistor 738. If both the transistor 733 and the transistor 738 turn their operational states to ON, electric power can be supplied from the terminal Vcc to a secondary side light emitting diode 734 of a phototriac coupler 740. The driving circuit illustrated in FIG. 10 further includes a current limiting resistor 737. If the phototriac coupler 740 turns on, then the TRIAC TR1 turns its operational state to ON. The driving circuit illustrated in FIG. 10 further includes two resistors 739 and 741 that serve as bias resistors for the TRIAC TR1.

If the MFG signal output from the pressing roller rotation detection unit 702 is in the HIGH level (when the pressing roller 108 is not rotating), the MASK signal has a pulse waveform (see the waveform 833 illustrated in FIG. 8) whose signal level alternately changes between HIGH and LOW every two consecutive periods of the AC power source. Therefore, electric power can be supplied to the TRIAC TR1 only when the MASK signal is in the LOW state. More specifically, if the pressing roller rotation detection unit 702 detects a non-rotational state of the pressing roller 108, a maximum value of the electric power suppliable to the heater 800 can be limited to 50%. Further, the CPU 703 can generate the MASK signal 833 by dividing the ZEROX signal into two.

Figure 8A:
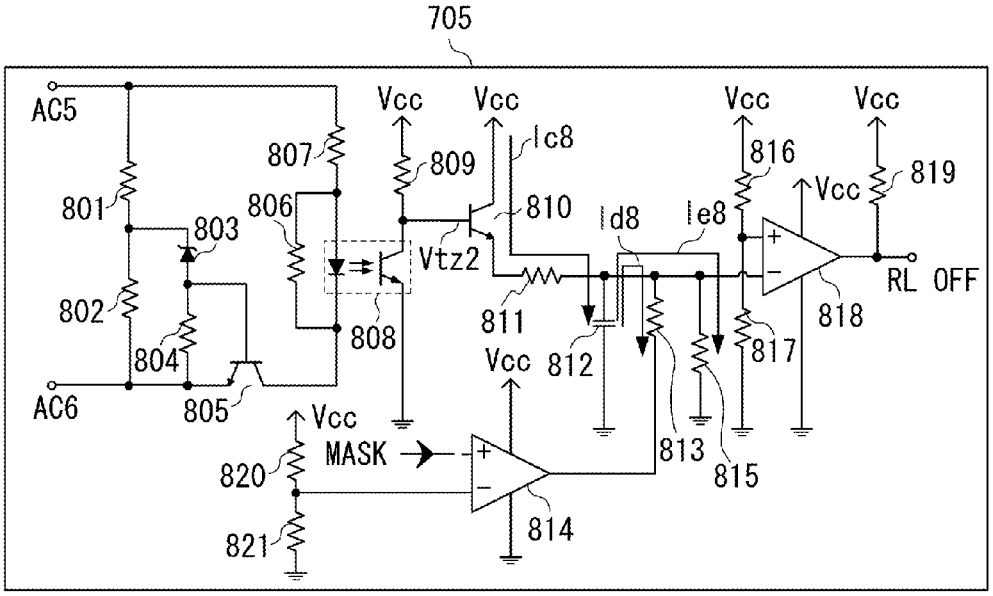
FIGS. 8A and 8B illustrate a configuration and an operation of a voltage detection circuit according to the second exemplary embodiment of the present invention.
Figure 8B:
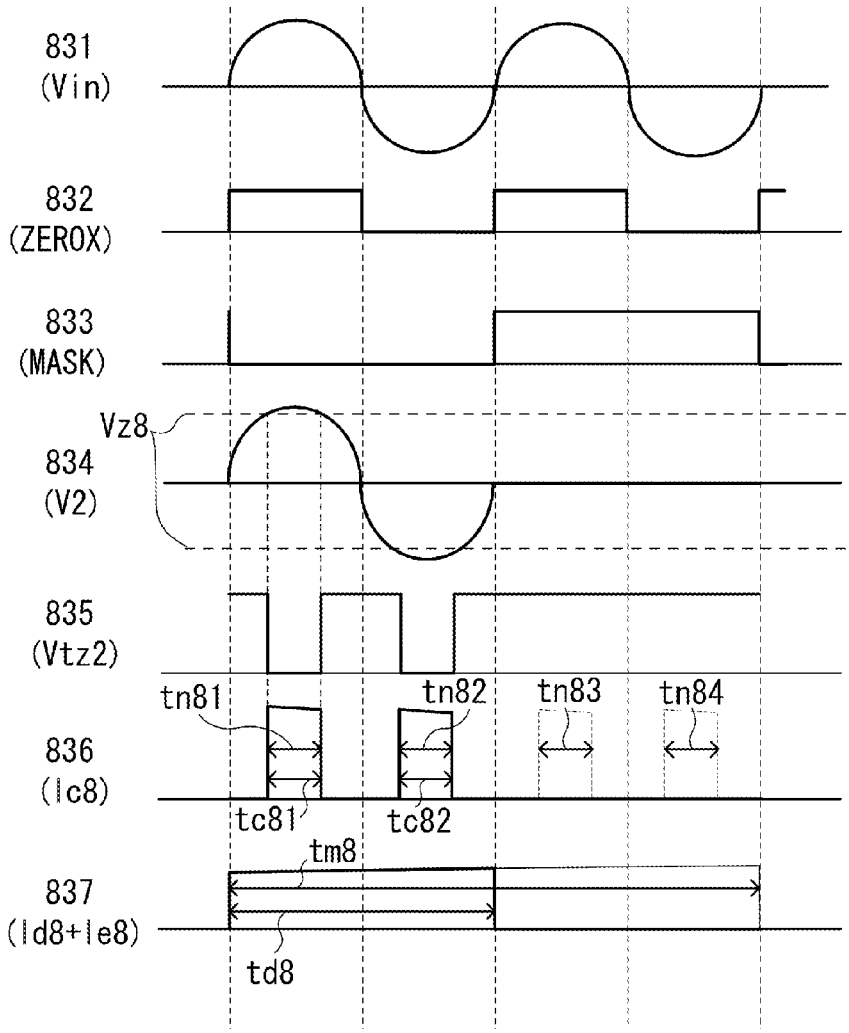

FIGS. 8A and 8B illustrate a circuit and operation waveforms of the voltage detection circuit 705 employed in the present exemplary embodiment. In this case, the heater 800 is in a failure state (corresponding to the failure state illustrated in FIG. 3D as described in the first exemplary embodiment). The power source voltage is 200 V. The heater 800 is in the second operational state (i.e., parallel connection state) in which the resistance value is low.

FIG. 8A illustrates a circuit configuration of the voltage detection circuit 705. The voltage V2 applied across the conductive path H2 of the heater is full-wave rectified by the diode bridge 707 and input between two terminals AC5 and AC6. If the voltage applied between two terminals AC5 and AC6 becomes equal to or greater than a threshold voltage value, a divided voltage obtained by two resistors 801 and 802 becomes higher than a Zener voltage of a Zener diode 803. If the voltage is applied to a resistor 804, an npn bipolar transistor 805 turns on. The current flows though a primary side light emitting diode of a photo-coupler 808 via a resistor 807.

The voltage detection circuit 705 illustrated in FIG. 8A includes a protective resistor 806 of the photo-coupler 808. If the current flows through the primary side light emitting diode of the photo-coupler 808, a secondary side transistor turns on and the current flows from the terminal Vcc via a resistor 809 and the gate voltage of a transistor 810 turns into a LOW level. If the transistor 810 turns its operational state to ON, a charging current Ic8 flows from the terminal Vcc to the capacitor 812 via a resistor 811.

Further, two discharge currents Id8 and Ie8 flow from the capacitor 812. The discharge current Ie8 is constantly discharged via a first discharge resistor 815. The discharge current Ie8 prevents the capacitor 812 from being charged by a leakage current from the transistor 810 and prevents the voltage detection circuit 705 from erroneously operating. The first discharge resistor 815 has a resistance value that is larger than that of a second discharge resistor 813.

The CPU 703 inputs the MASK signal to a comparator 814. If the MASK signal turns into a LOW level, the MASK signal becomes smaller than a comparison voltage (i.e., a threshold voltage) of the comparator 814. The comparison voltage of the comparator 814 is equal to the voltage of a division point between two resistors 820 and 821.

The discharge current Id8 flows via the second discharge resistor 813 to the GND. Therefore, the total current discharged from the capacitor 812 becomes greater. If the MASK signal turns into a HIGH level, the MASK signal becomes larger than the comparison voltage of the comparator 814 and an output terminal of the comparator 814 is brought into an opened state (i.e., an open collector state). Therefore, the total current discharged from the capacitor 812 becomes smaller.

If the voltage applied between two terminals AC5 and AC6 becomes higher, the rate of time (which is referred to as "ON Duty" or "ON time") during which the current flows through the primary side light emitting diode of the photo-coupler 808 becomes greater. The charging time of the capacitor 812 increases. The ratio of the charging time to the discharge time increases. The voltage of the capacitor 812 becomes higher.

If the voltage of the capacitor 812 becomes greater than a comparison voltage of a comparator 818, the current flows from the terminal Vcc to an output terminal of the comparator 818 via a resistor 819. The comparison voltage of the comparator 818 is equal to the voltage of a division point between two resistors 816 and 817. The voltage of an output RLOFF turns into a LOW level.

The voltage detection circuit 705 includes the bipolar transistor 805 that can steepen the rise/fall response of the current flowing through the primary side light emitting diode of the photo-coupler 808. Therefore, the voltage detection circuit 705 can accurately detect the AC power source voltage.

FIG. 8B illustrates an example operation of the voltage detection circuit 705 and the MASK signal that limits the electric power supplied to the heater 800 when the pressing roller 108 is not rotating. In this case, the TRM signal constantly remains in the ON state (electric power 100% control). The electric power supplied to the heater 800 is controlled by the MASK signal.

In FIG. 8B, a waveform 831 represents an AC input voltage supplied from the commercial AC power source. The ZEROX detection unit 206 outputs a ZEROX signal 832 of the AC input voltage 831. A waveform 833 represents the MASK signal that limits an operation of the TRIAC when the MFG signal is in the LOW level (when the pressing roller 108 is not rotating).

A waveform 834 is a voltage waveform in a state where the electric power supplied to the second conductive path H2 is limited by the MASK signal 833. The voltage waveform 834 is input to the voltage detection circuit 205 via the diode bridge 707. The input voltage is divided by the resistor 801 and the resistor 802.

If the divided voltage exceeds the Zener voltage of the Zener diode 803, the transistor 805 turns on and the current flows through the photo-coupler 808. A waveform 835 represents a gate voltage (Vtz2) of the transistor 810. The gate voltage Vtz2 is in a LOW level when the input voltage 834 exceeds a threshold voltage Vz8. A waveform 836 represents the charging current Ic8 flowing when the gate voltage (Vtz2) is in the LOW level.

A waveform 837 represents a discharge current that flows from the capacitor 812 to the GND. When the MASK signal 833 remains in the LOW level, the current discharged from the capacitor 812 is both the discharge current Id8 and the discharge current Ie8. If the MASK signal turns into a HIGH level, only the discharge current Ie8 flows and the total current discharged from the capacitor 812 becomes smaller.

In the waveform 836 of the charging current Ic8, if the electric power supplied to the heater 800 is 100%, the charging time of the capacitor 812 is equal to a sum of tn81 to tn84. If the electric power supplied to the heater 800 is 50%, the charging time of the capacitor 812 is equal to a sum of tc81 and tc82. The sum of tc81 and tc82 is a half of the sum of tn81 to tn84.

On the other hand, in the waveform 837 of the discharge current Id8, if the electric power supplied to the heater 800 is 100%, the discharge time is equal to tm8. Further, if the electric power supplied to the heater 800 is 50%, the discharge time is equal to td8. The time duration td8 is a half of the time duration tm8.

If the ratio of the charging time to the discharge time decreases, the saturation voltage of the capacitor 812 decreases and a higher voltage state may not be detected. In the voltage detection circuit 705 according to the present exemplary embodiment, if the electric power is supplied to the heater 800 at the rate of 50%, the charging time decreases to a half level and the discharge time decreases to a half level. Accordingly, the ratio of the charging time to the discharge time does not decrease.

More specifically, the voltage detection circuit 705 performs an electric power limiting control when the pressing roller 108 is not rotating. Even when the operational state of the TRIAC changes, the voltage detection circuit 705 controls the discharge time of the capacitor 812 according to the operational state of the TRIAC in such a way as to prevent the saturation voltage of the capacitor 812 from decreasing. Thus, the voltage detection circuit 705 can detect the failure state illustrated in FIG. 3D in which over-power may be supplied to the heater.

As described above, when the voltage detection circuit 705 according to the second exemplary embodiment is employed, the voltage detection circuit 705 can surely detect a state where over-power is supplied to a heat generation portion.

Figure 9A:
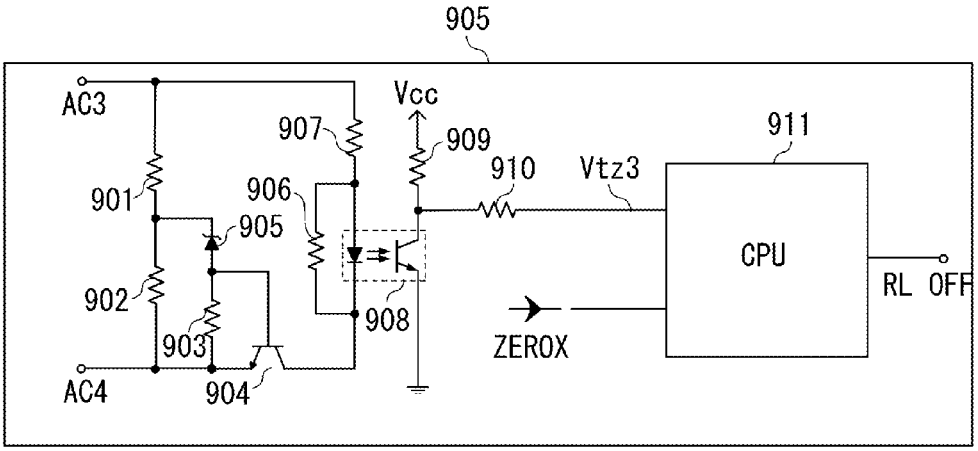
FIGS. 9A and 9B illustrate a configuration and an operation of a voltage detection circuit according to a third exemplary embodiment of the present invention.

Next, a third exemplary embodiment of the present invention is described below. A description for a configuration similar to that described in the first exemplary embodiment is not repeated. FIG. 9A illustrates a voltage detection circuit 905 according to the present exemplary embodiment. A primary side circuit configuration of the voltage detection circuit 905 is similar to that of the voltage detection circuit 705 described in the second exemplary embodiment and therefore the description thereof is not repeated.

If a voltage applied between two terminals AC3 and AC4 exceeds a threshold voltage Vz9, the current flows through a primary side light emitting diode of a photo-coupler 908. The threshold voltage Vz9 can be set by two voltage-division resistors 901 and 902 and a Zener diode 912. In response to the current flowing through the primary side light emitting diode, a secondary side transistor of the photo-coupler 908 turns on and the current flows from the terminal Vcc via a resistor 909 and an input voltage Vtz3 of a CPU 911 turns into a LOW level. The CPU 911 measures a period of time during which the input voltage Vtz3 remains in the LOW level. Example processing that can be performed by the CPU 911 is described below with reference to FIG. 9B.

Figure 9B:
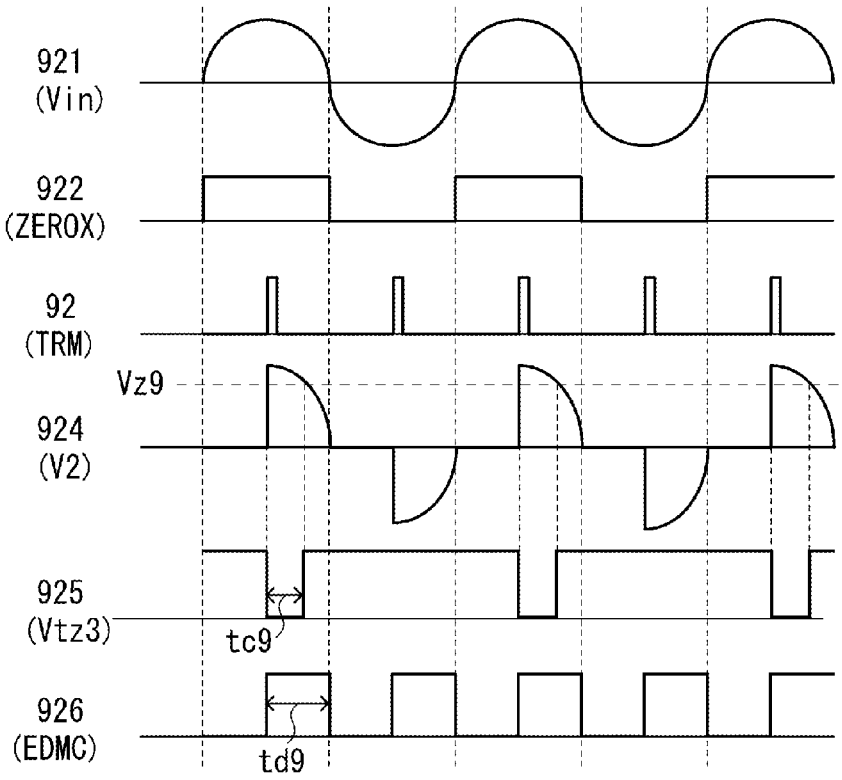

An example operation that can be performed by the voltage detection circuit 905 is described below with reference to FIG. 9B. In FIG. 9B, a waveform 921 represents an AC input voltage of the power source 201. The ZEROX detection unit 206 generates a ZEROX signal 922 based on the AC input voltage 921. A waveform 923 represents the TRM signal that controls an operation of the TRIAC TR1.

Electric power to be supplied to the heater 300 can be controlled by inputting the TRM signal to the TRIAC TR1. If the TRM signal 923 turns into a HIGH level, the TRIAC TR1 turns its operational state to ON. The TRIAC TR1 remains in the ON state until the ZEROX signal 922 turns into a lower level. A waveform 924 represents the voltage applied to the second conductive path H2. The electric power to be supplied to the heater 300 can be limited to 50%. The voltage waveform 924 is input to the voltage detection circuit 905 via the diode 207.

In this case, an input voltage Vtz3 of the CPU 911 turns into a LOW level when the voltage applied between two terminals AC3 and AC4 exceeds a threshold voltage Vz9. The threshold voltage Vz9 can be set by two voltage-division resistors 901 and 902 and a Zener diode 912. A waveform 925 represents the input voltage Vtz3 of the CPU 911.

A waveform 926 represents an EDMC signal that can be generated through signal processing that can be performed by the CPU 911. As described above with reference to the voltage detection circuit 205 according to the first exemplary embodiment, the EDMC signal 926 remains in the HIGH level after the TRM signal turns into a HIGH level until the zero cross signal 922 changes its state. The EDMC signal 926 turns into a LOW level when the operation state of the TRIAC is OFF. The EDMC signal 926 turns into a HIGH level when the operation state of the TRIAC is ON. Namely, the EDMC signal 926 turns into the HIGH level in a period of time during which the voltage is applied to the second conductive path H2.

The CPU 911 calculates a ratio of a time period tc9 during which the voltage Vtz3 925 turns into the LOW level to a time period td9 during which the voltage is applied to the second conductive path H2. If the calculated ratio becomes equal to or greater than a predetermined threshold, the CPU 911 determines that the heater 300 is in the failure state illustrated in FIG. 3D.

For example, in a case where the electric power is supplied to the heater 300 at the rate of 50%, the time period tc9 decreases to 50%. Simultaneously, the time period td9 decreases to 50%. Therefore, the ratio of the time period tc9 to the time period td9 calculated by the CPU 911 is constant. More specifically, when the voltage detection circuit 905 is employed, the voltage detection circuit 905 can eliminate the influence of the electric power control performed by the TRIAC TR1 and can detect the failure state illustrated in FIG. 3D.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-135501 filed Jun. 14, 2010, which is hereby incorporated by reference herein in its entirety.

What is claimed is:

1. A heating apparatus comprising:

a heater including a first current path and a second current path;

a switching unit configured to perform switching between a first operational state where the first current path is connected in series to the second current path and a second operational state where the first current path is connected in parallel to the second current path;

a power control unit configured to control electric power supplied to the first and second current paths; and a voltage detection unit configured to detect a voltage value applied to the first or second current path, wherein the voltage detection unit is configured to detect a first period during which the voltage value of the first current path or the second current path exceeds a threshold voltage and a second period during which the power control unit supplies electric power to the first current path or the second current path, and the voltage detection unit is configured to detect whether electric power is excessively supplied to the heater based on a ratio of the second period to the first period.

2. The heating apparatus according to claim 1, wherein if a ratio of the first period to the second period exceeds a predetermined setting value, the voltage detection unit detects a state that over-power is supplied to the heater.

3. The heating apparatus according to claim 1, wherein an element capable of obtaining a constant voltage sets the threshold voltage, and the element capable of obtaining the constant voltage includes a Zener diode or a shunt regulator.

4. The heating apparatus according to claim 1, wherein the voltage detection unit includes a capacitor that can store electric charge during the first period, a first discharge resistor that can discharge the capacitor during the first period, and a second discharge resistor that can discharge the capacitor during the second period, wherein a discharge resistance switching unit is provided to switch a discharge current from the capacitor between a discharge path via the first discharge resistor and a discharge path via the second discharge resistor, wherein the voltage detection unit detects that a state that over-power is supplied to the heater if a voltage value of the capacitor exceeds the threshold voltage.

5. The heating apparatus according to claim 1, further comprises a switch provided in a path supplying electric power to the heater, and if over-power is supplied to the heater, the switch stops the electric power supply to the heater.

6. The heating apparatus according to claim 1, wherein the heater includes a nip portion forming member that is configured to contact an inner surface of a cylindrical film or a belt and form a nip portion together with the heater via the film or the belt, wherein a recording material on which an image is formed can be sandwiched at the nip portion and heated by the heater while the recording material is conveyed.

7. The heating apparatus according to claim 6, further comprising:

a rotation detection unit configured to detect a rotational state of the nip portion forming member; and an electric power limiting unit configured to limit the electric power supplied to the heater if the rotation detection unit detects a non-rotational state of the nip portion forming member, wherein the second period is a period during which the electric power supplied to the heater is not limited by the electric power limiting unit.

8. The heating apparatus according to claim 1, wherein the first current path connects a first electrode to a second electrode, and the second current path connects the second electrode to a third electrode, wherein the third electrode is connected to a first power terminal of a power source, the second electrode is connected to a second power terminal of the power source via a first switch, and the first electrode is connected to either the first power terminal or the second power terminal via a second switch.

9. The heating apparatus according to claim 8, wherein the first switch is a make contact relay or a break contact relay, and the second switch is a break-before-make contact relay.

10. The heating apparatus according to claim 1, wherein the first current path connects a first electrode to a second electrode, and the second current path connects a third electrode to a fourth electrode, wherein the third electrode is connected to a first power terminal of a power source, the fourth electrode is connected to a second power terminal of the power source via a first switch, the second electrode is connected to a second power terminal of the power source, the first electrode is connected to the first power terminal of the power source via a second switch, and the first electrode is connected to the fourth electrode via the first switch and the second switch.

11. The heating apparatus according to claim 10, wherein the first switch is a break-before-make contact relay and the second switch is a break-before-make contact relay.

12. The heating apparatus according to claim 1, further comprising a power source voltage detection unit configured to detect a voltage value of a commercial AC power source, wherein a detection result obtained by the power source voltage detection unit is used to perform switching between the first operational state and the second operational state.

13. A voltage detection apparatus, which can be associated with a heater including a first current path and a second current path and can detect a voltage value applied to the first or second current path of the heater, the voltage detection apparatus comprising:

a first detection unit configured to detect a first period during which the voltage value of the first current path or the second current path exceeds a threshold voltage;

a second detection unit configured to detect a second period during which an power control unit supplies electric power to the first current path or the second current path in such a way as to control the electric power supplied to the first and second current paths, and a state detection unit configured to detect whether electric power is excessively supplied to the heater based on a ratio of the second period to the first period.

14. The voltage detection apparatus according to claim 13, wherein an element capable of obtaining a constant voltage sets the threshold voltage, and the element capable of obtaining the constant voltage includes a Zener diode or a shunt regulator.

15. An image forming apparatus that includes a heating device configured to heat a recording material on which an image is transferred and a pressing member that can be pressed against the heating device to form a nip portion, wherein the recording material is heated and pressed at the nip portion to fix the image formed on the recording material, image forming apparatus comprising:

a heater including a first current path and a second current path, wherein the heating device includes the heater;

a switching unit configured to perform switching between a first operational state where the first current path is connected in series to the second current path and a second operational state where the first current path is connected in parallel to the second current path;

an power control unit configured to control electric power supplied to the first and second current paths; and a voltage detection unit configured to detect a voltage value applied to the first or second current path, wherein the voltage detection unit is configured to detect a first period during which the voltage value of the first current path or the second current path exceeds a threshold voltage and a second period during which the electric power control unit supplies electric power to the first current path or the second current path, and the voltage detection unit is configured to detect whether electric power is excessively supplied to the heater based on a ratio of the second period to the first period.

16. The image forming apparatus according to claim 15, wherein if a ratio of the first period to the second period exceeds a predetermined setting value, the voltage detection unit is configured to detect a state that over-power is supplied to the heater.

17. A heating apparatus comprising:

a heater including first and second heat generation resistors;

a switching unit configured to switch a connection of the first and second heat generation resistors between a serial connection and a parallel connection;

a supply unit configured to supply power electric power to the first and second heat generation resistors;

a voltage detection configured to detect, during a first period when the electric power is supplied to the first and second heat generation resistors by the supply unit, a second period when a voltage of the first heat generation resistor or the second heat generation resistor is equal to or larger than a threshold value; and a determination unit configured to determine whether the heater is in an excessive power state according to a ratio of the second period to the first period.

18. The heating apparatus according to claim 17, wherein the second period is shorter than the first period, and the second period becomes shorter as the first period becomes shorter.

19. The heating apparatus according to claim 17, wherein, in a case where the determination unit determines that the heater is in the excessive power state, the supply unit stops supplying the electric power to the first and second heat generation resistors.

20. An image forming apparatus comprising:

a fixing unit including a heater including first and second heat generation resistors and configured to fix an image formed on a recording material;

a switching unit configured to switch a connection of the first and second heat generation resistors between a serial connection and a parallel connection;

a supply unit configured to supply power electric power to the first and second heat generation resistors;

a voltage detection unit configured to detect, during a first period when the electric power is supplied to the first and second heat generation resistors by the supply unit, a second period when a voltage of the first heat generation resistor or the second heat generation resistor is equal to or larger than a threshold value; and a determination unit configured to determine whether the heater is in an excessive power state according to a ratio of the second period to the first period.

21. The image forming apparatus according to claim 20, wherein the second period is shorter than the first period, and the second period becomes shorter as the first period becomes shorter.

22. The image forming apparatus according to claim 20, wherein, in a case where the determination unit determines that the heater is in the excessive power state, the supply unit stops supplying the electric power to the first and second heat generation resistors.

23. The image forming apparatus according to claim 20, wherein the fixing unit includes a film or a belt configured to hold the heater and a pressing unit configured to come into contact with the film or the belt and press the film or the belt, and a recording material is conveyed to a nip portion formed by the film or the belt and the pressing unit so that an image is fixed on the recording material.

24. A voltage detection circuit comprising:

a first detection unit configured to detect a first period when electric power is supplied to first and second heat generation resistors;

a voltage detection unit configured to detect a second period when a voltage of the first heat generation resistor or the second heat generation resistor is equal to or larger than a threshold value; and an output unit configured to output a signal indicating whether the heater is in an excessive power state according to a ratio of the second period to the first period.

* * * * *